US005911618A

United States Patent [19]

Dailey

[11] Patent Number: 5,911,618

[45] Date of Patent: Jun. 15, 1999

[54] DETACHABLE BRASSIERE STRAP BUCKLE AND ATTACHMENT RING

[76] Inventor: Sandra Dailey, 14742 Maplewood Ave., Harvey, Ill. 60426

[21] Appl. No.: 08/910,529

[22] Filed: Aug. 7, 1997

[51] Int. Cl.[6] ..... A41C 3/00; A41C 3/12

[52] U.S. Cl. ..... 450/86; 450/88; 2/336; 2/300

[58] Field of Search ..... 450/86, 88; 2/105, 2/106, 113, 114, 300, 301, 302, 303, 304, 305, 306, 307, 308, 309, 310, 311, 312, 313, 314, 315, 316, 317, 318, 319, 320, 321, 322, 323, 324, 325, 326, 327, 328, 329, 330, 331, 332, 333, 334, 335, 336, 337, 338, 339, 340, 341, 342; 24/600.7, 598.3

[56] References Cited

U.S. PATENT DOCUMENTS

| | | | |
|---|---|---|---|
| 2,849,723 | 9/1958 | Marino | 450/86 |
| 4,000,627 | 1/1977 | Wahlbeck | 63/2 |
| 4,430,778 | 2/1984 | Sandler | 24/239 |

*Primary Examiner*—Jeanette Chapman

[57] ABSTRACT

A new detachable brassiere strap buckle and attachment ring for replacing broken brassiere buckles and attachment rings. The inventive device includes a replaceable ring member and a replaceable buckle member. The detachable brassiere strap buckle and attachment ring help adjustibly secure the shoulder strap to the brassiere.

10 Claims, 3 Drawing Sheets

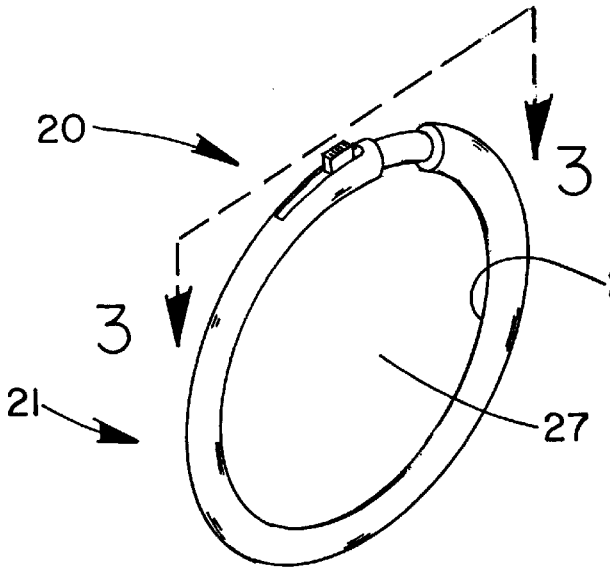
FIG. 1
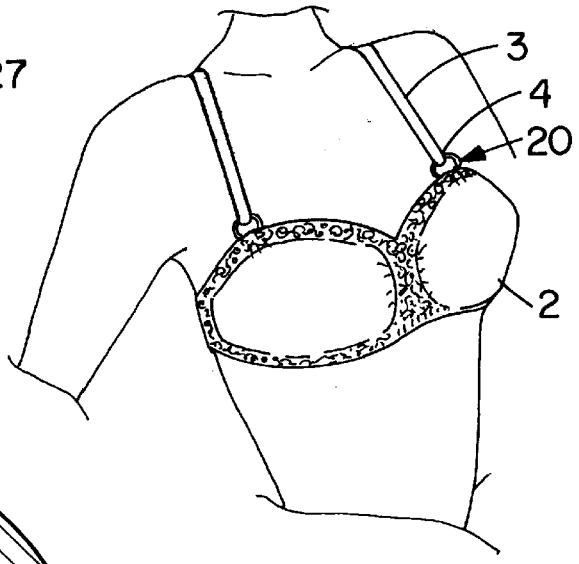
FIG. 2
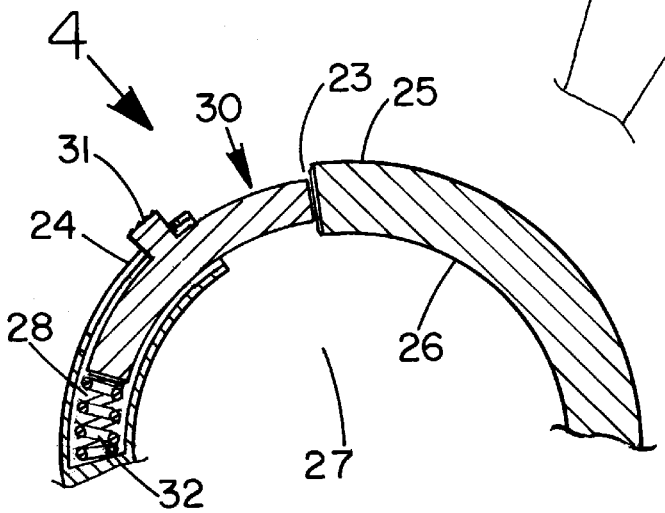
FIG. 3
FIG. 4
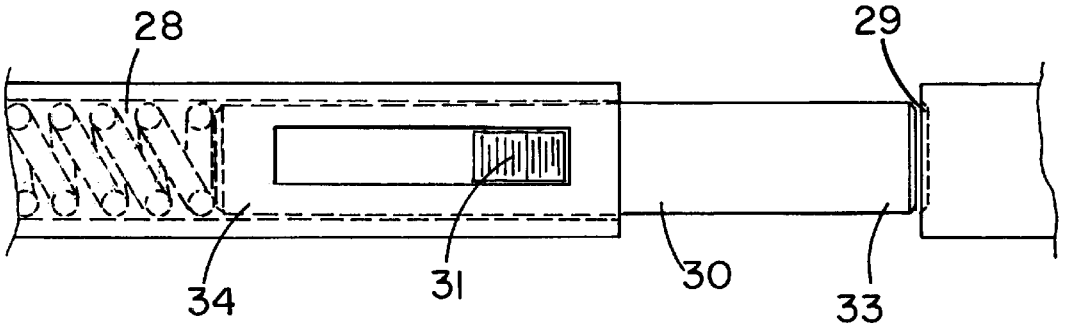

DETACHABLE BRASSIERE STRAP BUCKLE AND ATTACHMENT RING

BACKGROUND OF THE INVENTION

1. Field of the Invention

The present invention relates to brassieres and more particularly pertains to a new detachable brassiere strap buckle and attachment ring for replacing broken brassiere buckles and attachment rings.

2. Description of the Prior Art

The use of brassieres is known in the prior art. More specifically, brassieres heretofore devised and utilized are known to consist basically of familiar, expected and obvious structural configurations, notwithstanding the myriad of designs encompassed by the crowded prior art which have been developed for the fulfillment of countless objectives and requirements.

Known prior art brassieres include U.S. Pat. No. 5,380,238; U.S. Pat. No. 4,204,300; U.S. Pat. No. Des. 250,299; U.S. Pat. No. 4,000,544; U.S. Pat. No. 4,054,972; and U.S. Pat. No. 4,425,689.

While these devices fulfill their respective, particular objectives and requirements, the aforementioned patents do not disclose a new detachable brassiere strap buckle and attachment ring. The inventive device includes a replaceable ring member and a replaceable buckle member. The detachable brassiere strap buckle and attachment ring help adjustibly secure the shoulder strap to the brassiere.

In these respects, the detachable brassiere strap buckle and attachment ring according to the present invention substantially departs from the conventional concepts and designs of the prior art, and in so doing provides an apparatus primarily developed for the purpose of replacing broken brassiere buckles and attachment rings.

SUMMARY OF THE INVENTION

In view of the foregoing disadvantages inherent in the known types of brassieres now present in the prior art, the present invention provides a new detachable brassiere strap buckle and attachment ring construction wherein the same can be utilized for replacing broken brassiere buckles and attachment rings.

The general purpose of the present invention, which will be described subsequently in greater detail, is to provide a new detachable brassiere strap buckle and attachment ring apparatus and method which has many of the advantages of the brassieres mentioned heretofore and many novel features that result in a new detachable brassiere strap buckle and attachment ring which is not anticipated, rendered obvious, suggested, or even implied by any of the prior art brassieres, either alone or in any combination thereof.

To attain this, the present invention generally comprises a replaceable ring member and a replaceable buckle member. The detachable brassiere strap buckle and attachment ring help adjustibly secure the shoulder strap to the brassiere.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new detachable brassiere strap buckle and attachment ring apparatus and method which has many of the advantages of the brassieres mentioned heretofore and many novel features that result in a new detachable brassiere strap buckle and attachment ring which is not anticipated, rendered obvious, suggested, or even implied by any of the prior art brassieres, either alone or in any combination thereof.

It is another object of the present invention to provide a new detachable brassiere strap buckle and attachment ring which may be easily and efficiently manufactured and marketed.

It is a further object of the present invention to provide a new detachable brassiere strap buckle and attachment ring which is of a durable and reliable construction.

An even further object of the present invention is to provide a new detachable brassiere strap buckle and attachment ring which is susceptible of a low cost of manufacture with regard to both materials and labor, and which accordingly is then susceptible of low prices of sale to the consuming public, thereby making such detachable brassiere strap buckle and attachment ring economically available to the buying public.

Still yet another object of the present invention is to provide a new detachable brassiere strap buckle and attachment ring which provides in the apparatuses and methods of the prior art some of the advantages thereof, while simultaneously overcoming some of the disadvantages normally associated therewith.

Still another object of the present invention is to provide a new detachable brassiere strap buckle and attachment ring for replacing broken brassiere buckles and attachment rings.

Yet another object of the present invention is to provide a new detachable brassiere strap buckle and attachment ring which includes a replaceable ring member and a replaceable buckle member. The detachable brassiere strap buckle and attachment ring help adjustibly secure the shoulder strap to the brassiere.

Still yet another object of the present invention is to provide a new detachable brassiere strap buckle and attachment ring that allows a convenient means for repairing broken adjustment buckles and attachment rings on a brassiere.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of a detachable ring embodiment of a new detachable brassiere strap buckle and attachment ring.

FIG. 2 is a perspective view of the detachable ring embodiment on a brassiere.

FIG. 3 is a partial cross sectional view taken from line 3—3 of FIG. 1 of the detachable ring embodiment.

FIG. 4 is a partial side view of the detachable ring embodiment as viewed from the arrow 4 on FIG. 3 detailing the tongue.

DESCRIPTION OF THE PREFERRED EMBODIMENT

Figure 5:
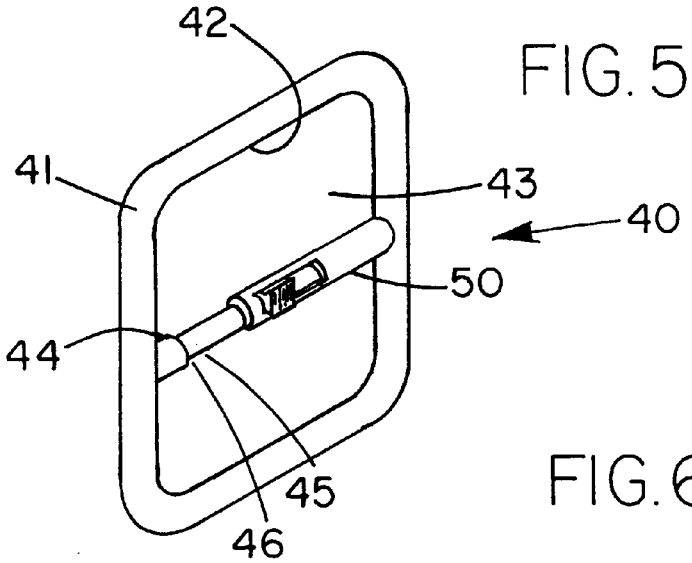
FIG. 5 is a perspective view of a detachable adjustable strap buckle embodiment of the present invention.

With reference now to the drawings, and in particular to FIGS. 1 through 8 thereof, a new detachable brassiere strap buckle embodying the principles and concepts of the present invention and generally designated by the reference numeral 10 will be described.

As best illustrated in FIGS. 1 through 8, the detachable brassiere strap buckle and attachment ring 10 is designed to replace broken parts of a brassiere 2 and includes a replaceable ring member 20 and a replaceable buckle member 40. The detachable brassiere strap buckle and attachment ring 10 help adjustibly secure the shoulder strap 3 to the brassiere 2.

The ring member 20 has a frame 21 that is substantially C-shaped with a frame break 23 being formed between its first and second ends 24,25. The inner periphery 26 of the frame defines an inner opening 27 as shown in FIG. 1.

The ring member 20 also includes a tongue 30 slidably mounted to the frame 21. The tongue 30 extends from the frame first end 24 towards the frame second end 25 and is slidable therebetween. Ideally, the tongue 30 is mounted to the frame 21 by insertion of the bottom end 34 into a bore 28 in the first end 24 of the frame 21. Preferably, the tongue 30 is biased towards the second end 25 to substantially close the frame break 23. Ideally, the tongue 30 is biased towards the second end 25 by a biasing means 32, such as a spring, provided within the bore 28 as shown in FIG. 3. The biasing means 32 aids in substantially closing the frame break 23.

Preferably, a knob 31 extends from the tongue 30 to aid the sliding of the tongue 30. Ideally, the spring 32 biases the tongue top end 33 into the second end 25 helping to secure the ring member 20. Ideally, as shown in FIG. 4, the second end 25 has a second end bore 29 allowing the top end 33 of the tongue 30 to be inserted therein to help securely close the frame break 23.

The buckle member 40 has a frame 41 with an inner periphery 42 defining an inner opening 43. The buckle member 40 also has a prong 44 that extends from one portion of the inner periphery 42 of the frame 41 toward an other portion of the inner periphery 42 of the frame 41 as shown in FIG. 5. The prong 50 is also biased toward the other portion of the inner periphery 42.

Figure 6:
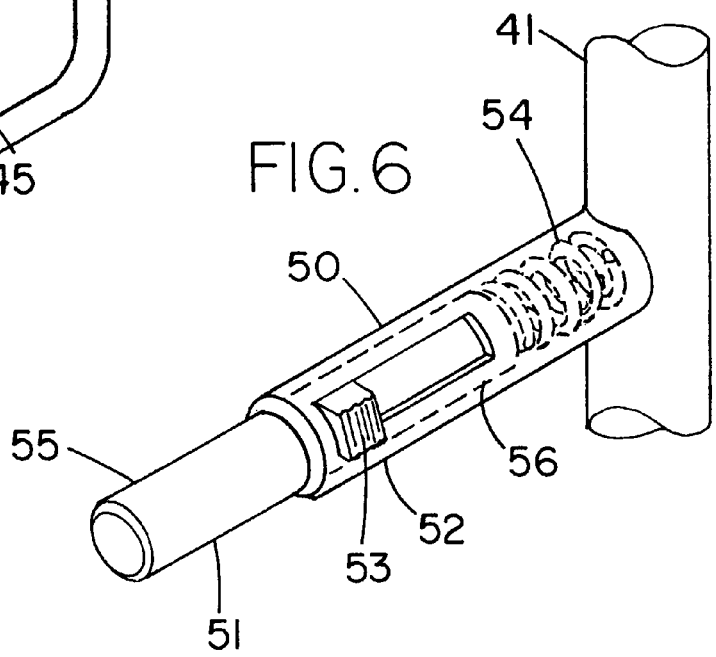
FIG. 6 is a partial perspective view of the adjustable strap buckle embodiment detailing the prong.

Preferably, the prong 50 includes a tongue portion 51 and a tube portion 52. The tube portion 52 extends from the inner periphery 42. The tongue portion 51 is slidably mounted to the tube portion 52. Ideally, the tongue portion 51 is slidably mounted to the tube portion 52 by insertion of the tongue bottom end 34 into the lumen of the tube portion 52. Preferably, the tongue 30 is biased toward the other portion of the inner periphery 42 by a biasing means 32 such as spring. Ideally, the tongue 30 is biased by a spring 32 provided within the lumen of the tube portion 52 as shown in FIG. 6.

Preferably, a knob 53 extends from the tongue portion 51 to aid in sliding the tongue portion 51 away from the rest 44. Ideally, the rest 44 has a rest bore 46 allowing the top end 55 of the tongue portion 51 to be inserted therein to help securely close the gap 45.

Preferably, as shown in FIG. 5, a rest 44 extends from the other portion of the inner periphery 42 so that when the top end 55 of the tongue portion 51 is slid towards the other portion, it may be abutted against the rest 44. Ideally, the rest 44 has a rest bore 46 allowing the top end 55 to be inserted therein to help secure the prong 50 when the prong 55 is extended toward the rest 44.

In use, the ring member 20 is designed to replace a similarly shaped broken ring of the brassiere 2 as shown in FIG. 2. Illustratively, when using the ring member to repair a broken ring, the first step is to slide the tongue top end 33 away from the second end 25 towards the first end 24 to open the frame break 23. The knob 31 may be used to help slide the tongue 30 between the second end 25 and the first end 24.

The shoulder strap looped end 4 may then be inserted through the frame break 23. The tongue 30 is then slid towards the second end 25 so that the shoulder strap looped end 4 is looped around the tongue 30. The tongue 30 is slid towards the second end 25 until the tongue top end 33 abuts against the second end 25 to secure the shoulder strap 3 to the brassiere 2. Ideally, the tongue top end 33 is also inserted into the second end bore 22 to further secure the shoulder strap 3 to the brassiere 2 as shown in FIG. 2.

Figure 7:
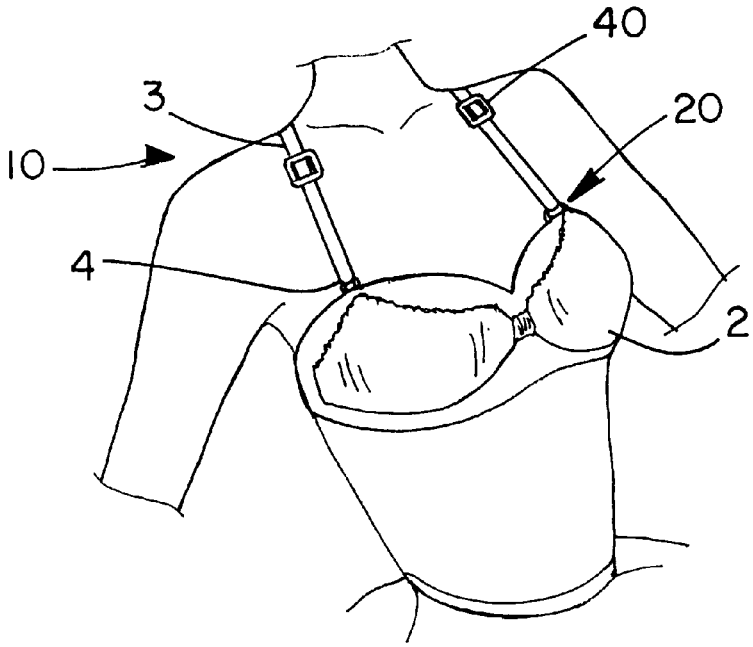
FIG. 7 is a partial perspective view of the detachable ring embodiment and of the adjustable strap buckle embodiment on a brassiere.
Figure 8:
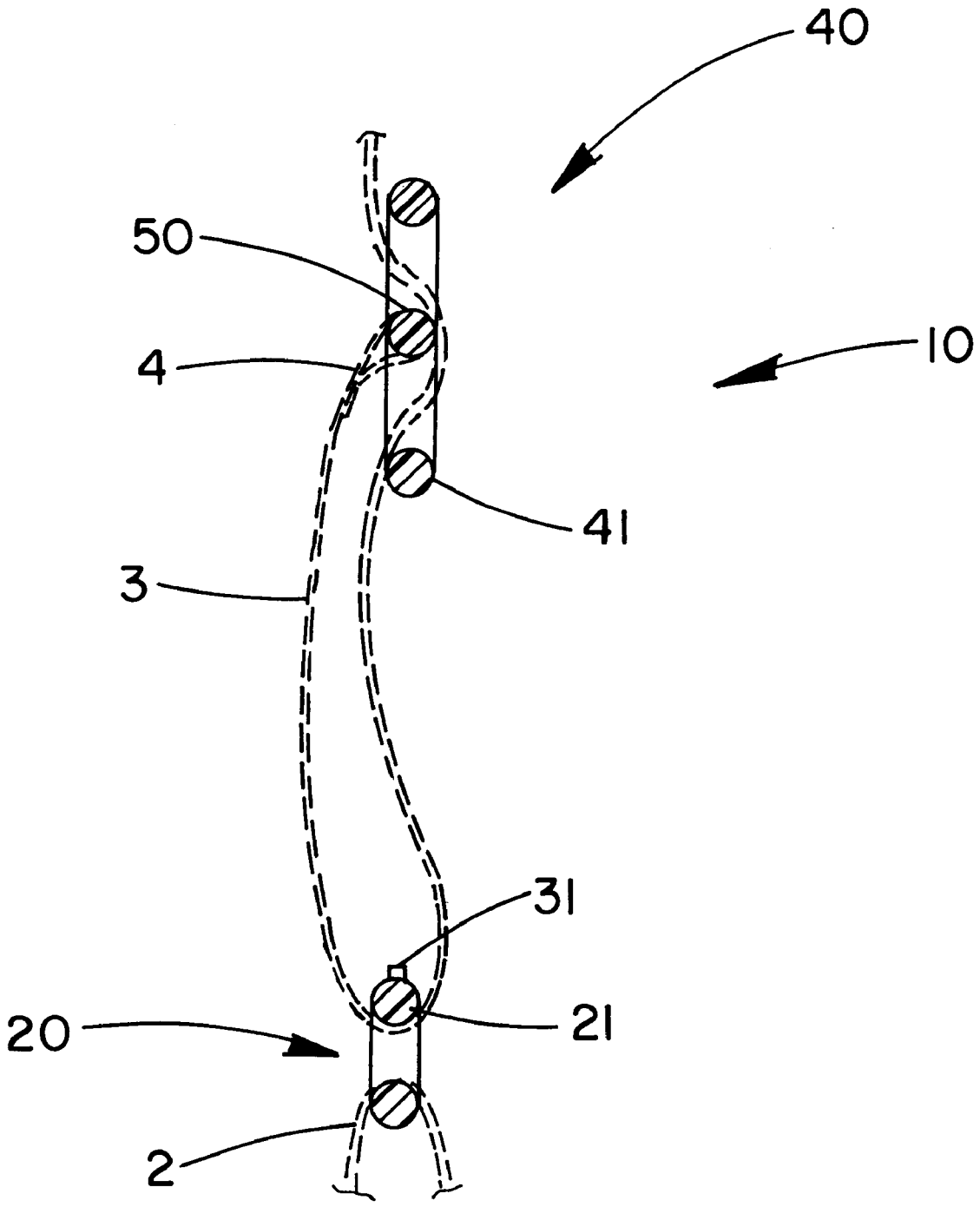
FIG. 8 is a side view of the shoulder strap attached to the buckle member and looped through the ring member.

In use, the buckle member 40 is designed to replace a similar shaped buckle member of the brassiere 2 as shown in FIG. 7. Typically, the shoulder strap 3 is looped through the ring member 20 and the looped end 4 is attached to the buckle member 40. Illustratively, the shoulder strap is first weaved around the prong 50 as shown in FIG. 8. The shoulder strap looped end 4 is inserted through the inner opening 27 so that the shoulder strap 3 is looped around the ring member 20. The shoulder strap looped end 4 is attached to the buckle member 40 by first sliding the tongue portion top end 55 away from the rest 44 towards the tube portion 52 to form a gap 45 between the tongue portion 51 and the rest 44. The knob 53 may be used to help slide the tongue portion top end 55 between the rest 44 and the tube portion 52.

The shoulder strap looped end 4 is then inserted through the gap 45. The tongue portion 51 is slid towards the rest 44 so that the shoulder strap looped end 4 is looped around the tongue portion 51. The tongue portion 51 is slid towards the rest 44 until the tongue portion top end 55 abuts against the rest 44 to secure the shoulder strap 3 to the brassiere 2. Ideally, the tongue portion top end 55 is also inserted into the rest bore 46 to further secure the shoulder strap 3 to the brassiere 2.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A piece of apparel, comprising:

a brassiere having a shoulder strap;

a ring member including:

a C-shaped frame having a first end, a second end, a break between said first end and said second end, and an inner periphery defining an interior opening;

a tongue being slidably mounted to said C-shaped frame first end, said tongue being extended from said C-shaped frame first end towards said C-shaped frame second end, said tongue being slidable towards said C-shaped frame second end to substantially close said C-shaped frame break;

said C-shaped frame of said ring member being coupled to a front portion of said brassiere; and wherein said shoulder strap is extended through said C-shaped frame interior opening and being looped around said C-shaped frame so that said shoulder strap is attached to the front portion of the brassiere by the ring member.

2. The piece of apparel from claim 1, wherein said tongue is biased towards said C-shaped frame second end to substantially close said C-shaped frame break.

3. The piece of apparel of claim 1, further comprising a buckle member, said buckle member including:

a frame having an inner periphery defining an interior opening;

a prong being extended from one portion of said frame inner periphery towards an other portion of said frame inner periphery, said prong being biased towards said other portion of said frame inner periphery; and wherein said shoulder strap being looped around said prong.

4. The piece of apparel of claim 3, wherein said prong is biased towards said other portion of said frame inner periphery.

5. A piece of apparel, comprising:

a brassiere having a shoulder strap;

a ring member including:

a C-shaped frame having a first end, a second end, a break between said first end and said second end, and an inner periphery defining an interior opening;

a tongue being slidably mounted to said C-shaped frame first end, said tongue being extended from said C-shaped frame first end towards said C-shaped frame second end, said tongue being slidable towards said C-shaped frame second end to substantially close said C-shaped frame break; and wherein said shoulder strap is extended through said C-shaped frame interior opening and being looped around said C-shaped frame;

a buckle member, said buckle member including:

a frame having an inner periphery defining an interior opening; and a prong being extended from one portion of said frame inner periphery towards an other portion of said frame inner periphery, said prong being biased towards said other portion of said frame inner periphery;

wherein said shoulder strap being looped around said prong;

wherein said prong is biased towards said other portion of said frame inner periphery;

a rest being extended from said inner periphery, said prong being extended from said one portion of said frame inner periphery towards said rest.

6. The piece of apparel of claim 5, wherein said prong has a tongue portion and a tube portion, said tube portion being extended from a portion of said frame inner periphery, said tongue portion being slidably mounted to said tube portion, said tongue portion being extended towards said rest, said tongue portion being biased towards said rest.

7. A brassiere, comprising:

a brassiere having a shoulder strap;

a buckle member including:

a frame having an inner periphery defining an interior opening;

a rest being extended from said inner periphery;

a prong having a tongue portion and a tube portion, said tube portion being extended from a portion of said frame inner periphery, said tongue portion being slidably mounted to said tube portion, said tongue portion being extended towards said rest, said tongue portion being biased towards said rest;

wherein said shoulder strap being looped around said prong;

a ring member including:

a C-shaped frame having a first end, a second end, a break between said first end and said second end, and an inner periphery defining an interior opening;

a tongue being slidably mounted to said C-shaped frame first end, said tongue being extended from said C-shaped frame first end towards said C-shaped frame second end, said tongue being biased towards said C-shaped frame second end to substantially close said C-shaped frame break; and wherein said shoulder strap being extended through said C-shaped frame interior opening and being looped around said C-shaped frame.

8. A method for replacing a brassiere, comprising the steps of:

providing a brassiere having a shoulder strap;

providing a buckle member, said buckle member including:

a frame having an inner periphery defining an interior opening;

a rest being extended from said inner periphery;

a prong having a tongue portion and a tube portion, said tube portion being extended from a portion of said frame inner periphery, said tongue portion being slidably mounted to said tube portion, said tongue portion being extended towards said rest, said tongue portion being biased towards said rest;

sliding said tongue portion away from said rest;

inserting said shoulder strap through the gap between said prong tongue portion and said rest;

sliding said tongue portion towards said rest; and looping said shoulder strap around said prong.

9. The method of claim 8, further comprising the step of providing a ring member, said ring member including:

a C-shaped frame having a first end, a second end, a break between said first end and said second end, and an inner periphery defining an interior opening; and a tongue being slidably mounted to said C-shaped frame first end, said tongue being extended from said C-shaped frame first end towards said C-shaped frame second end, said tongue being biased towards said C-shaped frame second end to substantially close said C-shaped frame break.

10. The method of claim 9, further comprising the steps of:

sliding said tongue away from said C-shaped frame second end to open said C-shaped frame break;

inserting said shoulder strap through said C-shaped frame break to extend said shoulder strap through said C-shaped frame interior opening;

sliding said tongue toward said C-shaped frame second end to substantially close said C-shaped frame break; and looping said shoulder strap around said C-shaped frame.

* * * * *